US006619755B1

(12) United States Patent
Christensen et al.

(10) Patent No.: US 6,619,755 B1
(45) Date of Patent: Sep. 16, 2003

(54) MACHINE FOR AUTOMATICALLY REMOVING TEMPORARY RAISED PAVEMENT MARKERS (TRPMS) FROM ROADWAY SURFACES

(75) Inventors: Michael Christensen, Parkers Prairie, MN (US); Jeffrey Arnold Wilkens, Reiles Acres, ND (US); Jeffrey Rogers, Alexandria, MN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/247,432

(22) Filed: Sep. 20, 2002

(51) Int. Cl.[7] ..... E01C 23/08
(52) U.S. Cl. ..... 299/39.2; 299/41.1
(58) Field of Search ..... 299/39.1, 39.2, 299/41.1; 404/85–86, 112, 93–94

(56) References Cited

U.S. PATENT DOCUMENTS

| | | | | |
|---|---|---|---|---|
| 1,766,073 A | | 6/1930 | Hartzler et al. | |
| 1,833,124 A | | 11/1931 | Rand | |
| 2,585,117 A | * | 2/1952 | Gurries | 404/86 |
| 3,380,428 A | | 4/1968 | Abrams | |
| 3,963,362 A | | 6/1976 | Hollis | |
| 4,111,581 A | | 9/1978 | Auriemma | |
| 4,186,967 A | * | 2/1980 | Kuhmonen | 299/41.1 X |
| 4,445,803 A | | 5/1984 | Dixon | |
| 4,521,129 A | | 6/1985 | Krech et al. | |
| 4,534,673 A | | 8/1985 | May | |
| 4,542,709 A | | 9/1985 | Spaugh | |
| 4,645,168 A | | 2/1987 | Beard | |
| 4,991,994 A | | 2/1991 | Edouart | |
| 5,070,656 A | * | 12/1991 | Brogden | 299/41.1 X |
| 5,327,850 A | | 7/1994 | Sly et al. | |
| 5,392,728 A | | 2/1995 | Speer et al. | |
| 5,393,166 A | | 2/1995 | Stock et al. | |
| 5,460,115 A | | 10/1995 | Speer et al. | |
| 5,515,807 A | | 5/1996 | Speer et al. | |
| 5,605,381 A | * | 2/1997 | Schmoock, Jr. et al. | 299/39.2 |
| 5,788,405 A | | 8/1998 | Beard | |
| 6,042,299 A | * | 3/2000 | Cooper | 404/83 |
| 6,109,820 A | | 8/2000 | Hughes, Sr. | |

FOREIGN PATENT DOCUMENTS

| | | |
|---|---|---|
| WO | WO95/2731 | 1/1995 |

* cited by examiner

*Primary Examiner*—Heather Shackelford
*Assistant Examiner*—Sunil Singh
(74) *Attorney, Agent, or Firm*—Schwartz & Weinrieb

(57) ABSTRACT

Apparatus for removing temporary raised pavement markers (TRPM) from roadway surfaces comprises a platform, and a plurality of cutter blades rotatably disposed beneath the platform for encountering and severing the upstanding vertical reflective portions of the temporary raised pavement markers (TRPM). The cutter blades are driven by a motor mounted upon an upper surface portion of the platform, and a blower is also mounted upon the upper surface portion of the platform. An upstream intake duct, fluidically connected to the intake side of the blower, passes through a rear end portion of the platform so as to be fluidically connected to the underside of the platform, and in this manner, the severed upper reflective portions of the temporary raised pavement markers (TRPM) may be removed from the roadway surface and conveyed to a suitable debris collection bag.

24 Claims, 8 Drawing Sheets

MACHINE FOR AUTOMATICALLY REMOVING TEMPORARY RAISED PAVEMENT MARKERS (TRPMS) FROM ROADWAY SURFACES

FIELD OF THE INVENTION

The present invention relates generally to temporary raised pavement markers (TRPMs) which are adapted to be fixedly secured to roadway surfaces in order to, for example, temporarily define traffic lanes or the like, and more particularly to a new and improved machine for automatically removing the temporary raised pavement markers (TRPMS) after their service within, for example, a construction zone, newly paved road section, or other work area, is no longer required in view of the completion of the particular construction project, maintenance work, and the like.

BACKGROUND OF THE INVENTION

Various types of roadway markers have been utilized in connection with a variety of traffic control applications. Many roadway markers are adapted to be permanently attached or secured to the road surface so as to permanently delineate traffic lanes upon the roadway, while other roadway markers are adapted to be temporarily attached or secured to particular road surfaces in order to temporarily delineate traffic lanes within construction zones or other work areas. Accordingly, the latter type of roadway markers are known as temporary roadway markers and are usually attached or secured to the road surface by means of a suitable adhesive that can retain the roadway marker in its place upon the road surface during the temporary life of the roadway marker. More particularly, temporary roadway markers can serve, for example, as a means for identifying edge portions of the roadway, or alternatively, to delineate traffic lane lines and thereby demarcate separate lanes of traffic from each other in and around construction sites and other work zones. After the construction or other road work is completed, the temporary roadway markers are to be removed.

To be effective, the temporary roadway markers must clearly be capable of alerting motorists to the fact that they are nearing or entering a construction zone or work area, and therefore, the temporary roadway markers must in fact be effective both during daytime hours, nighttime hours, sunny conditions, cloudy conditions, inclement weather conditions, and the like. More particularly, one type of temporary roadway marker that has been extremely successful or effective in providing short-term temporary markings upon roadways both during daytime and nighttime hours, and which has also been able to adequately withstand the various impact forces that are normally impressed thereon by daily roadway vehicular traffic so as to in fact provide the desired service life required in connection with the installation of such temporary roadway markers, has been that type of temporary roadway marker which is known in the industry as a temporary raised pavement marker (TRPM). Examples of such temporary raised pavement markers (TRPMs) are disclosed, for example, within U.S. Pat. No. 6,109,820 which issued to Hughes, Sr. on Aug. 29, 2000, U.S. Pat. No. 5,788,405 which issued to Beard on Aug. 4, 1998, U.S. Pat. No. 5,460,115 which issued to Speer et al. on Oct. 24, 1995, U.S. Pat. No. 4,991,994 which issued to Edouart on Feb. 12, 1991, and U.S. Pat. No. 4,445,803 which issued to Dixon on May 1, 1984.

As can readily be appreciated from FIG. 1, which corresponds substantially to FIG. 1 of the Speer et al. patent, it is briefly noted that an exemplary temporary raised pavement marker (TRPM) 10 is seen to have a substantially L-shaped configuration wherein the horizontally disposed leg portion 12 thereof is adapted to be fixedly secured or attached to the road surface by means of a suitable adhesive which is allowed to set, while the vertically upstanding leg portion 14 is adapted to be visually seen by the oncoming motorist. A transition region 26 flexibly interconnects the vertically upstanding leg portion 14 to the fixed leg portion or base member 12. A pair of rib members or ledges 28,28 extend substantially perpendicular to the upstanding leg member 14 and serve to define a space or channel 22 therebetween. A suitable reflective strip 23 is adapted to be fixedly disposed within the space or channel 22 so as to reflect sunlight or a vehicle's lights in order to provide the oncoming motorist, as indicated by the arrow 25, with a visual indication that the motorist is approaching or entering a construction zone or work area. Alternatively, in lieu of the reflective strip 23, the entire marker 10 may simply be brightly colored so as to similarly provide the oncoming motorist with the necessary visual warning.

With reference being further made to FIG. 2, a temporary raised pavement marker (TRPM), which is similar to the temporary raised pavement marker (TRPM) 10 disclosed in FIG. 1 of the present drawings as well as within FIG. 1 of the Speer et al. patent, is disclosed at 110 and is seen to likewise have a substantially L-shaped configuration. In particular, the temporary raised pavement marker (TRPM) 110 comprises a horizontally disposed leg or base member 112, and a vertically upstanding leg member 114 integrally connected to the horizontally disposed leg or base member 112 by means of a transitional region 116. An adhesive pad 118 is fixedly secured to an undersurface or lower face portion of the horizontally disposed leg or base member 112, and in turn, a release sheet 120 is secured to an undersurface or lower face portion of the adhesive pad 118 so as to prevent the adhesive pad 118 from being inadvertently adhesively bonded to any surface, other than that particular location or portion of the roadway to which the temporary raised pavement marker (TRPM) 110 is to be fixedly secured, prior to the actual fixation of the temporary raised pavement marker (TRPM) 110 upon a selected location or portion of the roadway. As was the case with the temporary raised pavement marker (TRPM) 10 of FIG. 1 of the present drawings as well as those of Speer et al., the upper end portion of the vertically upstanding leg member 114 of the temporary raised pavement marker (TRPM) 110 also comprises a pair of horizontally disposed rib members 122,122 which define a space or channel 124 therebetween for housing or accommodating a suitable reflector strip, not shown. Alternatively, the entire extrusion comprising the temporary raised pavement marker (TRPM) 110 may be fabricated from a suitable plastic material which is brightly colored, that is, it may be fabricated from a suitable resin material which is white or yellow.

The temporary raised pavement markers (TRPM) 110 are normally placed upon the roadway surface during an extended period of time that construction or other road work is being performed upon the roadway surface, and therefore prior to the completion of the entire construction or other road work as well as the application of the permanent traffic lane lines to the roadway surface. Accordingly, in order to protect the reflector strip, not shown, which is adapted to be disposed, housed, or accommodated within the space or channel 124 defined between the pair of horizontally disposed rib members 122,122, or alternatively, in order to protect the upper portion of the vertically upstanding leg member 114 when such portion of the temporary raised pavement marker (TRPM) 110 is to be used as the visual warning to oncoming motorists, from road paving materials, debris, and the like, a protective cover 126, fabricated from a suitable clear plastic material and having a substantially inverted U-shaped configuration, is disposed over the upper free edge portion of the temporary raised pavement marker (TRPM) 110. When the temporary raised pavement markers (TRPM) 110 are to be subsequently used in conjunction with, for example, their traffic lane delineation functions, the protective covers 126 are removed, and still further, when the need for the temporary raised pavement markers (TRPM) 110 is no longer required in view of the completion of the construction or other roadwork, and the application of the permanent traffic lane lines to the roadway surface, the temporary raised pavement markers (TRPM) 110 must obviously be removed from the roadway surface. Until now, such removal process was accomplished manually whereby construction workmen or other personnel would have to manually sever or otherwise remove the temporary raised pavement markers (TRPM) 110 from the roadway surface. Obviously, such procedures are quite tedious and time-consuming. In addition, in view of the fact that the construction workmen or other personnel are physically present upon the particular roadway surface during the performance of such temporary raised pavement marker (TRPM) removal operations, the workmen or personnel are unnecessarily exposed to dangerous vehicular conditions present upon the roadway.

A need therefore exists in the art for a new and improved device, machine, or apparatus for automatically removing temporary raised pavement markers (TRPM) from roadway surfaces after they have served their useful purpose and/or service life, whereby the temporary raised pavement markers (TRPM) can be removed in a relatively rapid manner, whereby the construction workmen or other operator personnel do not need to tediously perform such removal operations manually, and in addition, and just as importantly, whereby the operator personnel or construction workers will not be needlessly exposed to dangerous roadway conditions presented by oncoming automotive vehicular traffic.

OBJECTS OF THE INVENTION

Accordingly, it is an object of the present invention to provide a new and improved device or apparatus for removing temporary raised pavement markers (TRPM) from roadway surfaces.

Another object of the present invention is to provide a new and improved device or apparatus for removing temporary raised pavement markers (TRPM) from roadway surfaces whereby the operational drawbacks and disadvantages characteristic of the PRIOR ART techniques currently employed for removing the temporary raised pavement markers (TRPM) from roadway surfaces are effectively overcome.

An additional object of the present invention is to provide a new and improved device or apparatus for removing temporary raised pavement markers (TRPM) from roadway surfaces wherein the temporary raised pavement markers (TRPM) can be automatically removed from the roadway surfaces.

A further object of the present invention is to provide a new and improved device or apparatus for removing temporary raised pavement markers (TRPM) from roadway surfaces wherein the temporary raised pavement markers (TRPM) can be automatically removed from the roadway surfaces such that construction workers or other operator personnel do not have to manually remove such temporary raised pavement markers (TRPM) from the roadway surfaces in a tedious and relatively slow manner.

A last object of the present invention is to provide a new and improved device or apparatus for removing temporary raised pavement markers (TRPM) from roadway surfaces wherein the temporary raised pavement markers (TRPM) can be automatically removed from the roadway surfaces such that the construction workers or other operator personnel do not have to manually remove such temporary raised pavement markers (TRPM) from the roadway surfaces and thereby not be unnecessarily exposed to dangerous roadway conditions presented by oncoming automotive vehicular traffic.

SUMMARY OF THE INVENTION

The foregoing and other objectives are achieved in accordance with the teachings and principles of the present invention through the provision of a new and improved device, machine, or apparatus for removing temporary raised pavement markers (TRPM) from roadway surfaces which comprises a platform upon the front end of which a mounting plate is bolted or otherwise fastened for rotatably supporting a pair of front wheel assemblies. A pair of trailer hitch bracket assemblies are also fixedly secured upon the mounting plate so as to permit the device, machine, or apparatus to be towed by means of a roadwork vehicle or truck. A plurality of cutter blades are rotatably disposed beneath a forward end portion of the platform for encountering and severing the upstanding vertical reflective portions of the temporary raised pavement markers (TRPM), and the cutter blades are adapted to be driven by a suitable drive motor mounted upon an upper surface portion of the platform. A blower is also mounted upon an upper surface portion of the platform, and an upstream intake duct, fluidically connected to the intake side of the blower, passes through a rear end portion of the platform so as to be fluidically connected to the underside of the platform. In this manner, the severed upper reflective portions of the temporary raised pavement markers (TRPM) may be removed from the roadway surface and conveyed to a suitable debris collection bag.

In conjunction with the collection and removal of the severed portions of the temporary raised pavement markers (TRPM), a plurality of brushes are arranged in a substantially continuous manner around the entire periphery of the platform so as to effectively form or define a dependent curtain which extends vertically downwardly from the lower edge portion of the plat-form for operative engagement with the roadway surface as the device, apparatus, or machine is moved along the roadway surface. In addition, the platform, and therefore the brush curtain, has a convergent or tapered configuration, as considered in the direction extending from the front end portion thereof to the rear end portion thereof, and therefore, the severed upstanding reflective portions of the temporary raised pavement markers (TRPM) are automatically funneled toward the suction intake duct operatively associated with the blower so as to be accordingly removed.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
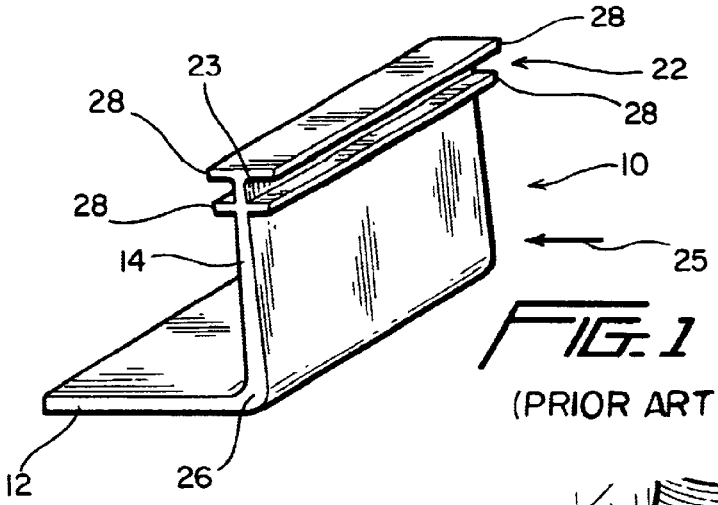
FIG. 1 (PRIOR ART)
FIG. 1 is a perspective view of a conventional PRIOR ART temporary raised pavement marker (TRPM)
Figure 6:
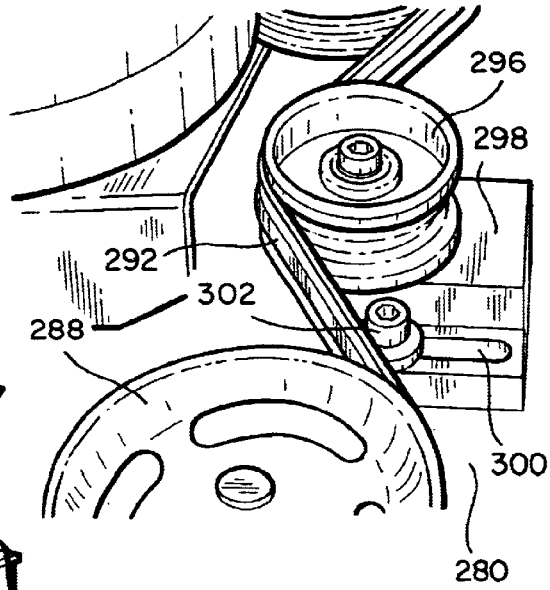
FIG. 6 is an enlarged perspective view of the motor drive system of FIG. 5 showing the details of the adjustable mounting of the tension pulley utilized in conjunction with the motor drive system for the cutter implements.
Figure 2:
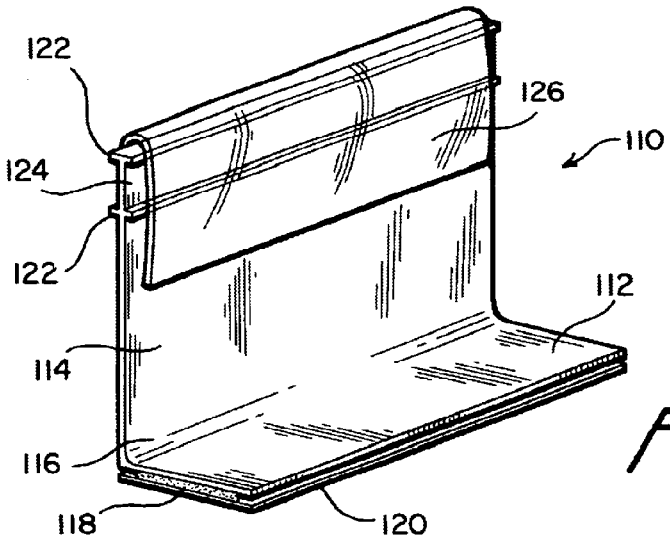
FIG. 2 is a perspective view of a temporary raised pavement marker (TRPM) of the type which is adapted to be severed and removed from a roadway surface, by means of the device, machine, or apparatus constructed in accordance with the principles and teachings of the present invention, when the operational service or utility of such temporary raised pavement marker (TRPM) is no longer required.
Figure 3:
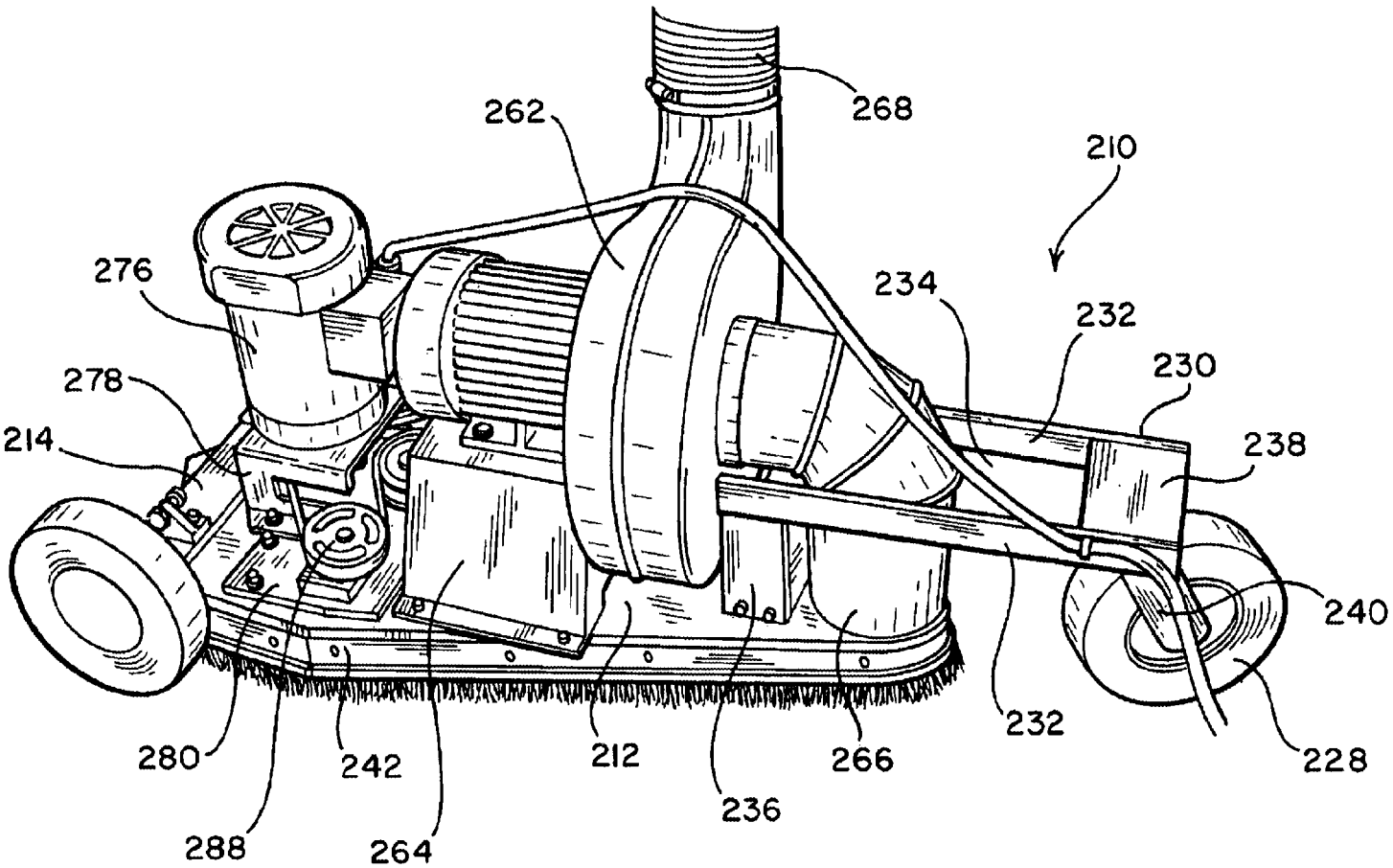
FIG. 3 is a top perspective view of a device, machine, or apparatus constructed in accordance with the principles and teachings of the present invention for severing and removing temporary raised pavement markers (TRPM), of the type which is shown in FIG. 2, from roadway surfaces.
Figure 4:
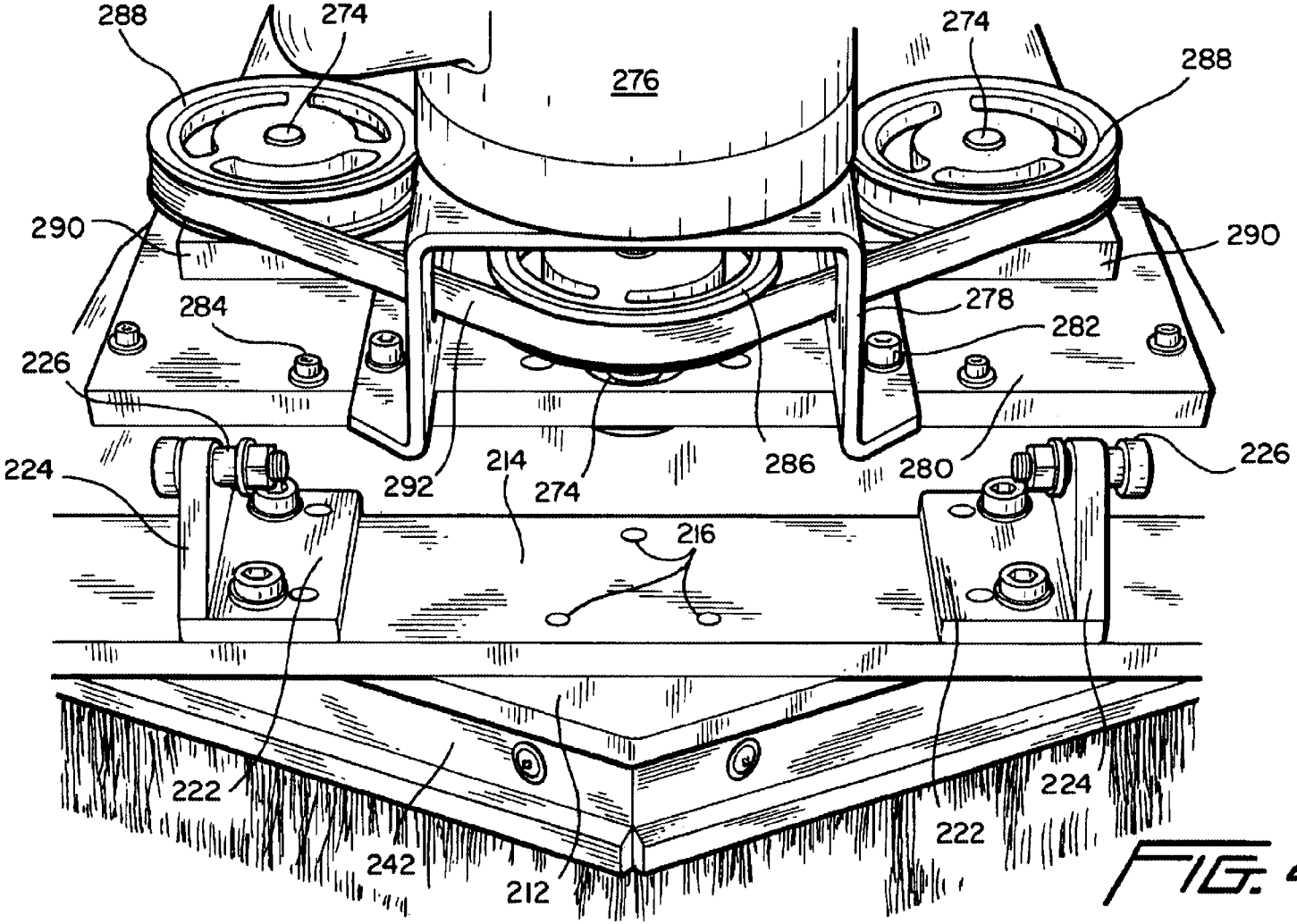
FIG. 4 is a front view of the machine illustrated within FIG. 3 particularly showing the details of the front wheel mounting plate and the cutter implement motor drive system.

Referring now to the drawings, and more particularly to FIGS. 3 and 4 thereof, the new and improved apparatus, machine, or device for automatically severing and removing the upstanding reflective portion of a temporary raised pavement marker (TRPM), such as that shown at 110 in FIG. 2, is disclosed and is generally indicated by the reference character 210. The machine or apparatus 210 is seen to comprise a horizontally disposed platform 212, and a laterally or transversely extending mounting plate 214 is bolted or riveted, as at 216, to a forward upper surface portion of the platform 212 as best seen in FIG. 4. As can best be seen from FIGS. 9 and 10, opposite ends of the mounting plate 214 have a pair of upstanding mounting brackets 218 integrally formed thereon, and a pair of front wheel assemblies 220,220 are adapted to be rotatably secured to the mounting brackets 218. In addition, a pair of laterally or transversely spaced towing hitch mounting brackets 222,222 are also fixedly secured upon the mounting plate 214 for operative connection to a suitable trailer hitch assembly, not shown, by means of which the entire machine or apparatus 210 of the present invention can be towed by a roadwork truck or vehicle schematically shown at 223. More particularly, each one of the trailer hitch mounting brackets 222,222 has an integral upstanding lug or ear 224, and a suitable nut and bolt assembly 226 is operatively associated therewith and passes therethrough for operative connection to the trailer hitch assembly, not shown. As best seen in FIG. 3, at the rear end of the machine or apparatus 210, there is provided a single rotatable and steerable wheel assembly 228, and in order to mount the rear wheel assembly 228 upon the machine or apparatus 210, a framework assembly 230 is utilized. The framework assembly 230 is seen to comprise a pair of longitudinally extending, transversely spaced frame members 232, 232 defining an open space 234 therebetween, and it is seen further that forward ends of the frame members 232,232 are fixedly secured to a housing 236 which is fixedly mounted upon a rearward upper surface portion of the platform 212. The rear ends of the frame members 232,232 are connected to opposite sides of a wheel platform 238, and a caster wheel type clevis assembly 240 is rotatably mounted upon an undersurface portion of the wheel platform 238.

Figure 5:
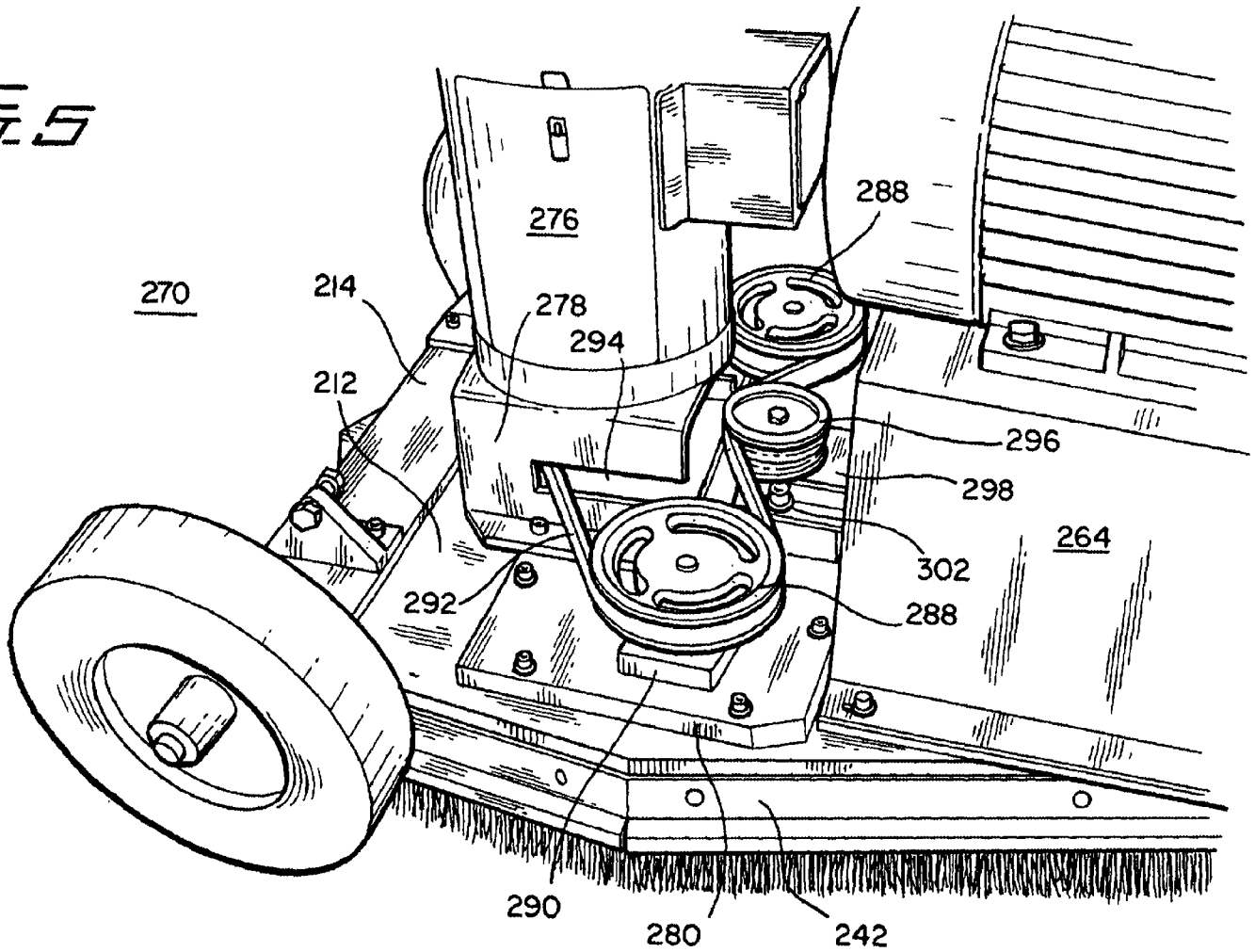
FIG. 5 is a side view of the machine illustrated within FIGS. 3 and 4 showing additional details of the front wheel mounting plate, the front wheels mounted upon the front wheel mounting plate, and the cutter implement motor drive system.
Figure 7:
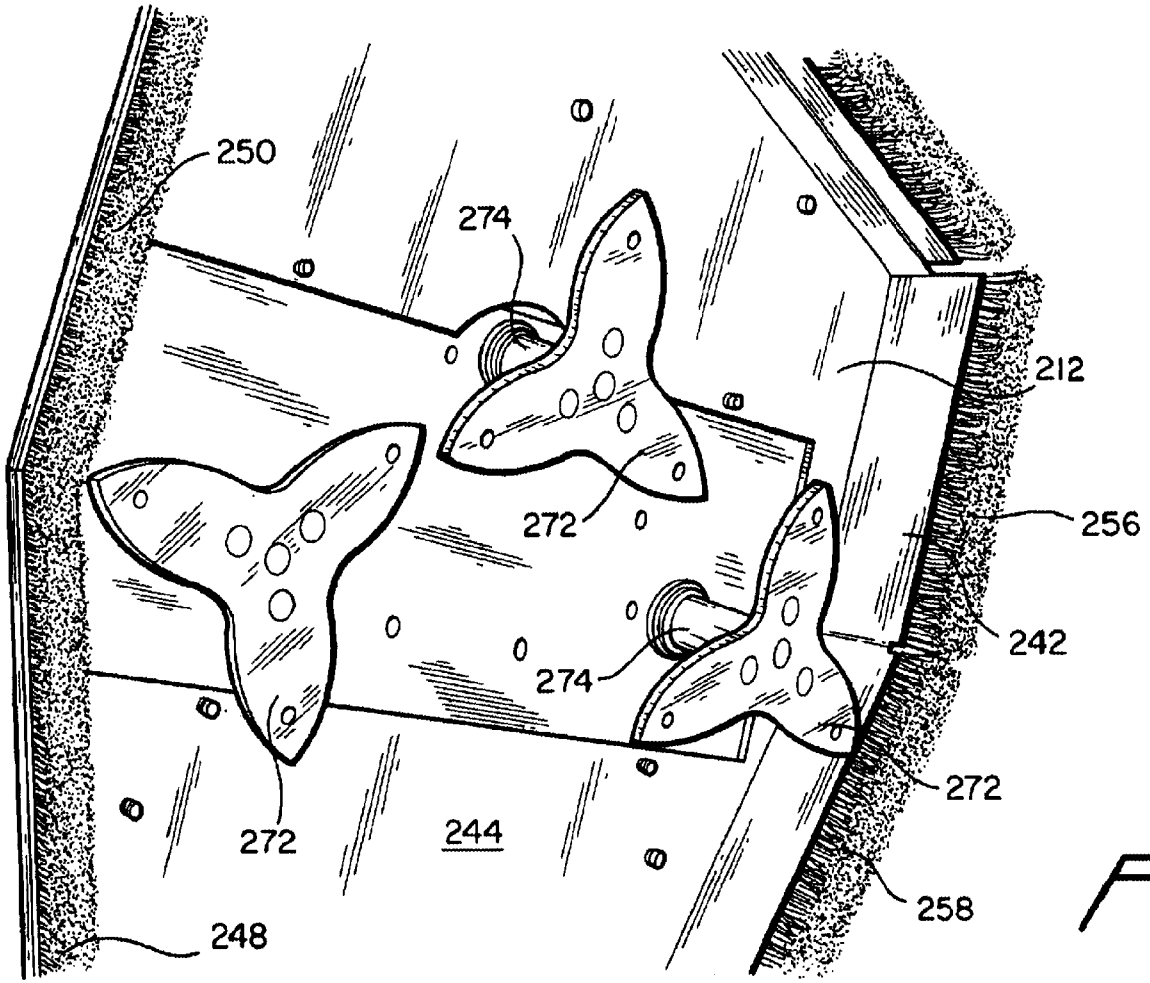
FIG. 7 is a bottom perspective view of the machine platform illustrating the mounting of the plurality of rotatable cutter implements thereon.
Figure 8:
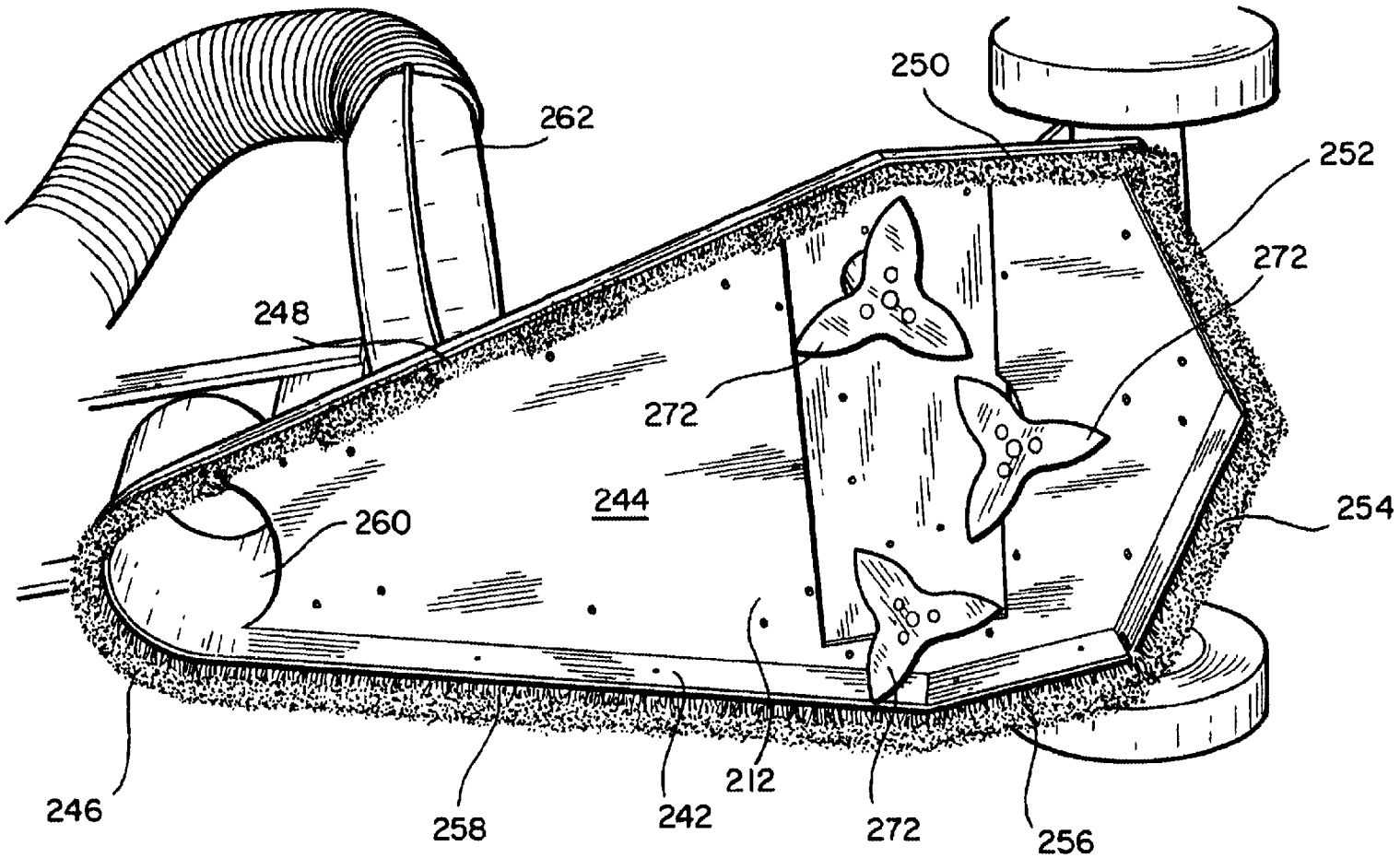
FIG. 8 is a bottom view of the machine or apparatus as illustrated within FIG. 3 showing the disposition of the cutter implements upon the underside of the platform, the convergent configuration of the platform and the peripheral dependent brush curtain, and the location of the suction intake duct for removing the severed vertically upstanding portions of the temporary raised pavement markers (TRPM)

As best seen in FIGS. 3–5, the platform 212 has a dependent skirt portion 242 disposed around the entire periphery of the platform 212, and accordingly, the undersurface or bottom interior surface 244 of the platform 212 is recessed as can best be appreciated from FIGS. 7 and 8. In addition, as is also best appreciated from FIG. 8, the platform 212 is seen to have a configuration which is substantially that of an isosceles triangle with the base of the triangle disposed at the front of the machine or apparatus 210 while the substantially equal sides of the triangle converge or taper toward the apex of the triangle which is disposed at the rear of the machine or apparatus 210. A plurality of brushes 246,248,250,252,254,256,258 are dependently secured to the lower edge portion of the skirt 242 of the platform 212 so as to collectively form a peripheral brush curtain which is adapted to engage the roadway surface.

It is also noted that a suction exhaust port 260 is defined within the undersurface 244 of the platform 212 at the apex region thereof, and in view of the aforenoted contact engagement of the various brush sections 246–258 with the roadway surface, the brush sections 246–258 effectively cause a substantially fluidically sealed recessed region to be defined underneath the platform 212. In addition, when suction air is caused to flow into and through the exhaust port 260, the structural convergence of the triangle sides of the platform 212, and the presence of the dependent peripheral skirt 242 and the collective brush curtain defined by means of the plurality of brushes 246–258 defining the aforenoted sealed region beneath the platform 212, all combine together to cause debris to be naturally or inherently collected and flow toward the exhaust port 260. In order to achieve such suction air flow through exhaust port 260, a suction blower 262 is mounted upon an upper surface portion of the platform 212, as best illustrated within FIG. 3, and a blower drive motor 264, which may either by gas-powered or electrically-powered, is operatively connected to the blower 262. The intake or suction side of the blower 262 is fluidically connected to the suction or exhaust port 260 through means of a suction or intake duct 266, and the exhaust side of the blower 262 is fluidically connected to an exhaust duct 268 which may, in turn, be fluidically connected to a suitable collection bin, container, or the like, not shown, within which debris can be deposited and collected.

Figure 9:
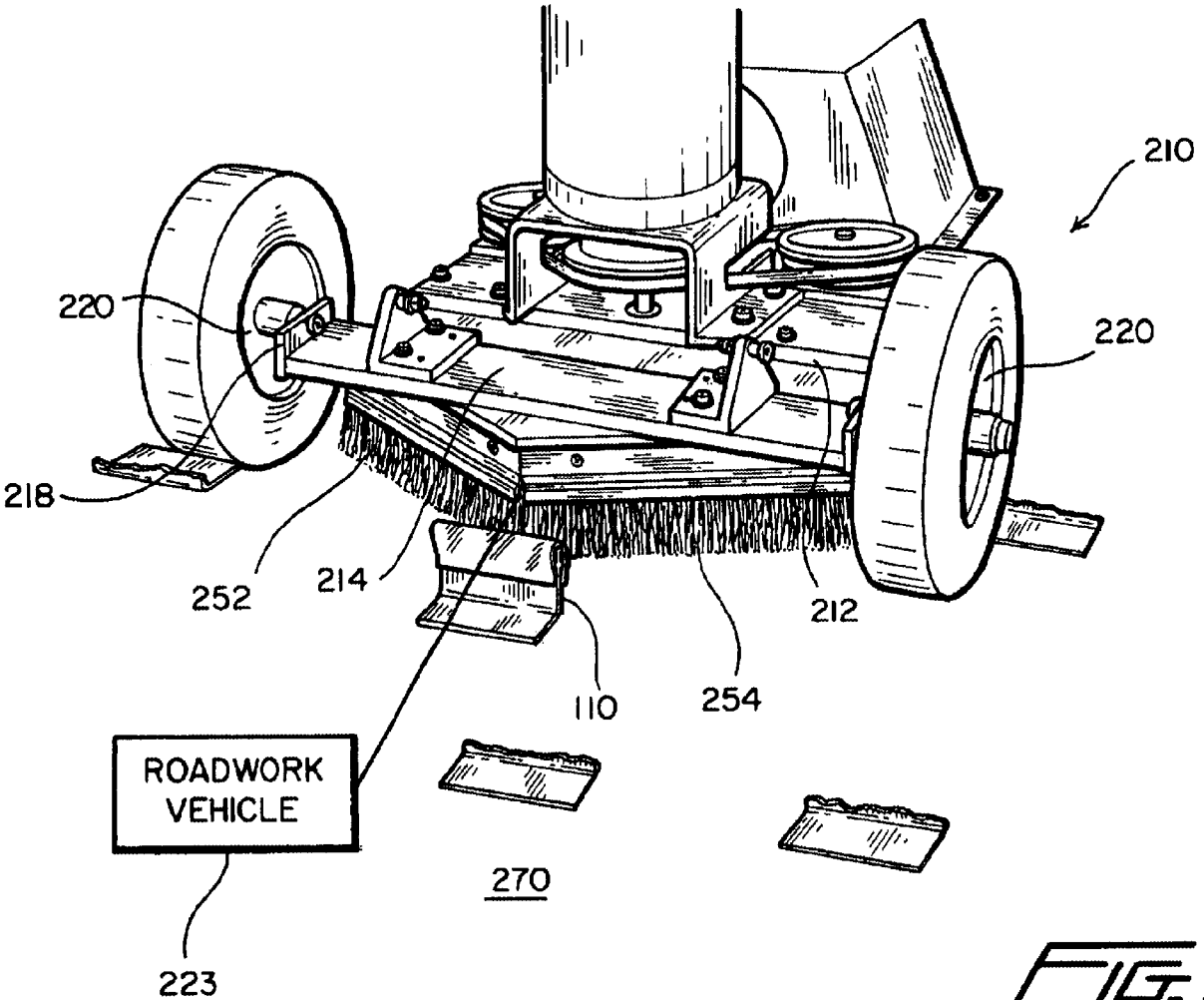
FIG. 9 is a front view showing the machine or apparatus of the present invention approaching a temporary raised pavement marker (TRPM) adhesively bonded to the roadway surface just prior to the severancce of the same from the roadway surface.
Figure 10:
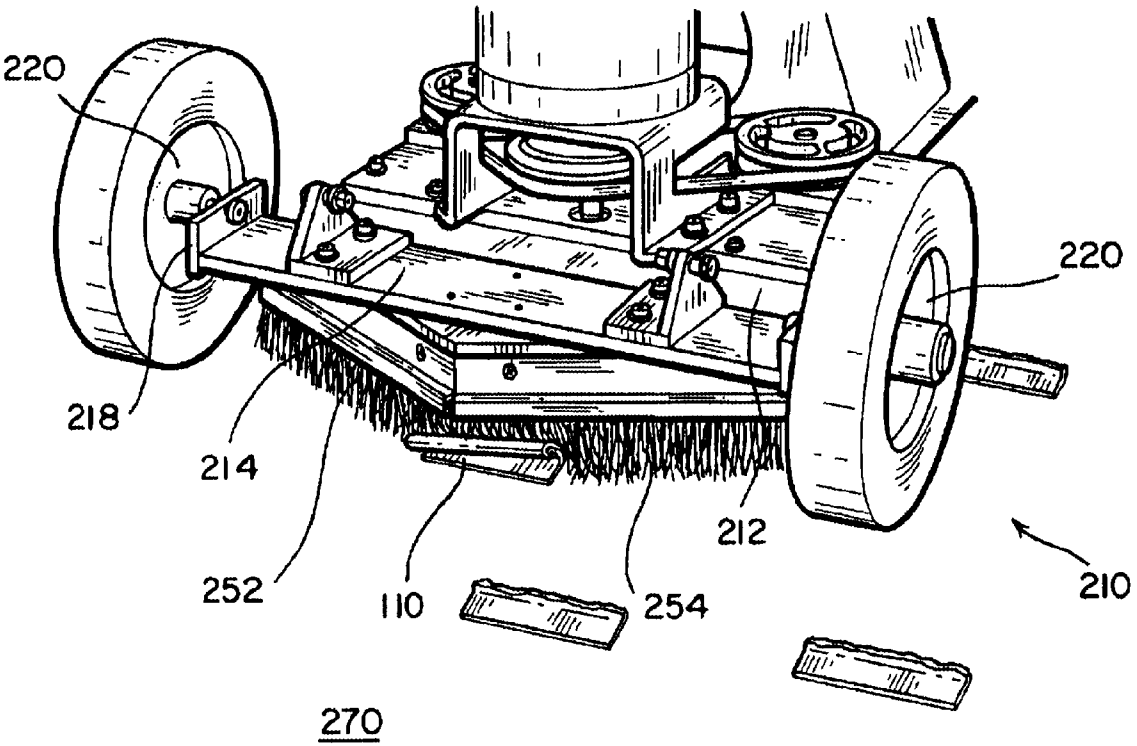
FIG. 10 is a view similar to that of FIG. 9 showing, however, the passage of the front portion of the machine or apparatus of the present invention over the temporary raised pavement marker (TRPM) just prior to the passage of the temporary raised pavement marker (TRPM) beneath the undercarriage of the machine or apparatus for severance and removal of the same from the roadway surface.

As disclosed within FIGS. 7 and 8, in order to actually achieve the severance of the vertically upstanding leg members 114 of the temporary raised pavement markers (TRPM) 110 when it is desired to effectively remove the temporary raised pavement markers (TRPM) 110, or at least the reflective portions thereof, from the roadway surface 270 as disclosed within FIGS. 9 and 10, a plurality of rotary cutter implements 272 are rotatably disposed beneath the undersurface portion 244 of the platform 212. Each one of the rotary cutter implements 272 is fixedly mounted upon the lower end of a rotary drive shaft 274 which extends downwardly through the platform 212 from a rotary drive system which is mounted upon the upper surface portion of the platform 212. More particularly, as illustrated within FIGS. 3–6, a drive motor 276, which may either be gas-powered or electrically powered, is integrally disposed atop a mounting bracket 278 which is fixedly mounted upon a mounting plate 280 by means of fasteners 282, and the mounting plate 280 is, in turn, fixedly secured to the platform 212 by means of fasteners 284. The drive motor 276 has its drive shaft depending downwardly therefrom, as can best be seen in FIG. 4, which serves as the rotary drive shaft 274 for the central one of the three cutter implements 272, and it is also seen that a drive pulley 286 is fixedly mounted upon the drive motor shaft 274.

In addition to the drive pulley 286, a pair of laterally spaced driven pulleys 288,288 are rotatably mounted upon auxiliary mounting plates 290,290, and the driven pulleys 288, 288 are fixedly connected to the upper end portions of the rotary drive shafts 274 of the other two cutter implements 272. A pulley drive belt 292 is disposed around the external peripheries of the drive and driven pulleys 288,288 whereby the rotary drive from the drive pulley 286 is able to be transmitted to the pair of driven pulleys 288, 288. In this manner, all of the three cutter implements 272 are simultaneously driven together. As can best be seen from FIG. 5, in order for the pulley drive belt 292 to be drivingly routed from the central drive pulley 286 to the laterally spaced driven pulleys 288,288, side portions of the drive motor mounting bracket 278 are slotted as at 294. In addition, it is also seen that in order to impress a predeterminedly desired amount of tension upon the pulley drive belt 292 such that the rotary drive can in fact be properly transmitted from the drive pulley 286 to the driven pulleys 288,288, a tension pulley 296 is located behind the drive motor mounting bracket 278 and the drive pulley 286 so as to be disposed in contact with an external surface portion of the pulley drive belt 292. More particularly, as can best be seen from FIG. 6, the tension pulley 296 is rotatably mounted upon a mounting bracket 298, and the mounting bracket 298 is adjustably mounted upon the mounting plate 280. Opposite lateral sides of the tension pulley mounting bracket 298 are slotted as at 300, and threaded bolt fasteners 302 pass through the mounting bracket slotted portions 300 for threaded engagement within threaded bores, not shown, defined within the mounting plate 280. Accordingly, when the bolt fasteners 302 are loosened, the mounting bracket 298 can be moved toward or away from the central drive pulley 286 so as to, in turn, move the tension pulley 296 toward and away from the central drive pulley 286 and thereby adjustably vary the level of tension imparted to the pulley drive belt 292. Upon tightening of the bolt fasteners 302, the mounting bracket 298 is of course fixed in place upon the mounting plate 280 so as to maintain the predetermined tension level within the pulley drive belt 292.

In operation, as can be readily appreciated from FIGS. 9 and 10, when it is desired to remove the plurality of temporary raised pavement markers (TRPM) 110, previously adhesively bonded to the roadway surface 270, from the roadway surface 270, the machine or apparatus 210 of the present invention is towed behind the roadwork vehicle or truck 223. Accordingly, as the machine or apparatus 210 approaches respective ones of the temporary raised pavement markers (TRPM) 110 as seen in FIG. 9, the front end portion of the apparatus or machine 210 will pass over the temporary raised pavement marker (TRPM) 110 as shown in FIG. 10 so as to temporarily cause the vertically upstanding leg member 114 of each marker 110 to be bent or deflected downwardly. As the forward brush sections 252,254 pass over the deflected leg member 114 of each temporary raised pavement marker (TRPM) 110, the resiliency inherent within the temporary raised pavement marker (TRPM) 110 permits the vertically upstanding leg member 114 thereof to regain its vertical orientation, thereby effectively presenting itself to the plurality of cutter implements 272. Rotation of the three cutter implements 272 by means of the drive motor 276, and the respective drive and driven pulleys 286,288, 288, will of course cause the upstanding vertical leg member 114 of each temporary raised pavement marker (TRPM) 110 to be severed from the adhesively bonded base portion 112 therefof, the sealed curtain region, effectively formed by means of the brushes 246–258, preventing the undesired scattering of the debris particles. As the machine or apparatus 210 of the present invention continues to move forwardly, the severed sections 114 of the temporary raised pavement markers (TRPM) 110 will therefore be effectively herded toward the rearwardly disposed suction or exhaust port 260 of the machine or apparatus 210 by means of the converging dependent brush sections 248,258 disposed along the triangular sides of the machine or apparatus 210. In addition, as a result of the simultaneous operation of the blower 262 upon the machine or apparatus 210, the severed upstanding leg members or portions 114 of each temporary raised pavement marker (TRPM) 110 will be sucked upwardly through the suction or exhaust port 260, through the suction intake duct 266, and exhausted out through the exhaust duct 268 toward the collection bag or bin, not shown.

Thus, it may be seen that in accordance with the principles and teachings of the present invention, there has been provided a new and improved machine for automatically removing temporary raised pavement markers (TRPM) from roadway surfaces wherein a platform has a motor mounted thereon for driving a plurality of cutter implements which are mounted beneath the platform, and a blower is fluidically connected to a suction port defined within a rear section of the platform. Accordingly, as the cutter implements sever the normally vertically upstanding leg members of the temporary raised pavement markers (TRPM), the suction blower removes the severed debris and conducts the same toward a collection bin or bag. As a result of such apparatus, the temporary raised pavement markers (TRPM) are able to be automatically severed and removed from the roadway surfaces without requiring manual operations by operator personnel so as not to expose operator personnel to unnecessary dangers inherently present from vehicular traffic on the roadways.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. Wheeled apparatus, adapted to be attached to an automotive roadwork vehicle so as to be movable along with the automotive roadwork vehicle as the automotive roadwork vehicle moves over a roadway surface, for automatically removing pavement markers from a roadway surface, comprising:

a platform;

at least one wheel assembly rotatably mounted upon said platform for rollably supporting said platform upon the roadway surface upon which the plurality of pavement markers, to be removed, are disposed;

means disposed upon said platform for permitting said platform to be attached to an automotive roadwork vehicle such that said apparatus can be movable along with the automotive roadwork vehicle as the automotive roadwork vehicle moves over the roadway surface;

at least one cutter implement mounted beneath said platform so as to be disposed at a predetermined position above the roadway surface in order to enable said at least one cutter implement to engage pavement markers fixedly mounted upon the roadway surface and sever the pavement markers from the roadway surface;

a drive motor mounted upon said platform and having a motor drive operatively connected to said at least one cutter implement so as to drive said at least one cutter implement for the performance of a cutting operation;

an exhaust port defined within said platform through which severed pavement marker debris can be exhausted; and a suction blower mounted upon said platform and fluidically connected to said exhaust port so as to remove severed pavement marker debris severed by said at least one cutter implement.

2. The apparatus as set forth in claim 1, wherein:

said at least one cutter implement mounted beneath said platform comprises a plurality of cutter implements.

3. The apparatus as set forth in claim 2, wherein:

said plurality of cutter implements comprises three cutter implements; and said motor drive operatively connected to said three cutter implements comprises a motor drive shaft upon which a first one of said three cutter implements is rotatably mounted, a drive pulley fixedly mounted upon said motor drive shaft, a pair of driven pulleys mounted upon driven shafts upon which second and third ones of said three cutter implements are mounted, and a drive belt operatively inter-connecting said drive pulley to said pair of driven pulleys.

4. The apparatus as set forth in claim 2, wherein:

said platform has a configuration which is substantially that of an isosceles triangle wherein the base portion of said isosceles triangle is located at the forward end of said platform as considered in the direction of movement of said apparatus along the roadway surface, and the side portions of said isosceles triangle converge toward the rear apex end of said platform;

said plurality of cutter implements are disposed beneath said forward end of said platform; and said exhaust port is defined within said rear end of said platform.

5. The apparatus as set forth in claim 4, further comprising:

brush means dependently supported from said platform in a peripheral array around said platform for engaging the roadway surface so as to effectively form a sealed region beneath said platform whereby severed pavement marker debris is effectively contained within said sealed region so as to facilitate the exhaust thereof through said exhaust port.

6. The apparatus as set forth in claim 4, further comprising:

brush means dependently supported from said platform in a peripheral array around said platform for engaging the roadway surface so as to effectively form a sealed region beneath said platform whereby as said apparatus is moved along the roadway surface, as a result of being attached to the roadwork vehicle, those sections of said brush means disposed along said convergent sides of said triangular platform will tend to funnel severed pavement marker debris toward said exhaust port.

7. The apparatus as set forth in claim 4, wherein:

said at least one wheel assembly rotatably mounted upon said platform comprises a pair of laterally spaced wheel assemblies mounted upon said forward base end of said platform, and a single steerable wheel assembly mounted upon said rear apex end of said platform.

8. The apparatus as set forth in claim 4, wherein:

said means disposed upon said platform for permitting said platform to be attached to the roadwork vehicle comprises trailer hitch means mounted upon said forward base end of said platform.

9. In combination, apparatus, attachable to an automotive roadwork vehicle so as to be movable along with the automotive roadwork vehicle as the automotive roadwork vehicle moves over a roadway surface, for automatically removing pavement markers from a roadway surface, comprising:

an automotive roadwork vehicle;

a platform secured to said automotive roadwork vehicle;

at least one wheel assembly rotatably mounted upon said platform for rollably supporting said platform upon the roadway surface upon which the plurality of pavement markers, to be removed, are disposed;

means disposed upon said platform for permitting said platform to be attached to said automotive roadwork vehicle such that said apparatus can be movable along with said automotive roadwork vehicle as said automotive roadwork vehicle moves over the roadway surface;

at least one cutter implement disposed beneath said platform so as to be disposed at a predetermined position above the roadway surface in order to enable said at least one cutter implement to engage pavement markers fixedly mounted upon the roadway surface and sever the pavement markers from the roadway surface;

a drive motor mounted upon said platform and having a motor drive operatively connected to said at least one cutter implement so as to drive said at least one cutter implement for the performance of a cutting operation;

an exhaust port defined within said platform through which severed pavement marker debris can be exhausted; and a suction blower mounted upon said platform and fluidically connected to said exhaust port so as to remove severed pavement marker debris severed by said at least one cutter implement.

10. The combination as set forth in claim 9, wherein:

said at least one cutter implement disposed beneath said platform comprises a plurality of cutter implements.

11. The combination as set forth in claim 10, wherein:

said plurality of cutter implements comprises three cutter implements; and said motor drive operatively connected to said three cutter implements comprises a motor drive shaft upon which a first one of said three cutter implements is rotatably mounted, a drive pulley fixedly mounted upon said motor drive shaft, a pair of driven pulleys mounted upon driven shafts upon which second and third ones of said three cutter implements are mounted, and a drive belt operatively inter-connecting said drive pulley to said pair of driven pulleys.

12. The combination as set forth in claim 10, wherein:

said platform has a configuration which is substantially that of an isosceles triangle wherein the base portion of said isosceles triangle is located at the forward end of said platform as considered in the direction of movement of said apparatus along the roadway surface, and the side portions of said isosceles triangle converge toward the rear apex end of said platform;

said plurality of cutter implements are disposed beneath said forward end of said platform; and said exhaust port is defined within said rear end of said platform.

13. The combination as set forth in claim 12, further comprising:

brush means dependently supported from said platform in a peripheral array around said platform for engaging the roadway surface so as to effectively form a sealed region beneath said platform whereby severed pavement marker debris is effectively contained within said sealed region so as to facilitate the exhaust thereof through said exhaust port.

14. The combination as set forth in claim 12, further comprising:

brush means dependently supported from said platform in a peripheral array around said platform for engaging the roadway surface so as to effectively form a sealed region beneath said platform whereby as said apparatus is moved along the roadway surface, as a result of being attached to said roadwork vehicle, those sections of said brush means disposed along said convergent sides of said triangular platform will tend to funnel severed pavement marker debris toward said exhaust port.

15. The combination as set forth in claim 12, wherein:

said at least one wheel assembly rotatably mounted upon said platform comprises a pair of laterally spaced wheel assemblies mounted upon said forward base end of said platform, and a single steerable wheel assembly mounted upon said rear apex end of said platform.

16. The combination as set forth in claim 12, further comprising:

said means disposed upon said platform for permitting said platform to be attached to the roadwork vehicle comprises trailer hitch means mounted upon said forward base end of said platform.

17. Wheeled apparatus, adapted to be attached to an automotive roadwork vehicle so as to be movable along with the automotive roadwork vehicle as the automotive roadwork vehicle moves over a roadway surface, for automatically removing pavement markers from a roadway surface, comprising:

at least one wheel assembly rotatably mounted upon said apparatus for rollably supporting said apparatus upon the roadway surface upon which the plurality of pavement markers, to be removed, are disposed;

means for attaching said apparatus to an automotive roadwork vehicle such that said apparatus can be movable along with the automotive roadwork vehicle as the automotive roadwork vehicle moves over the roadway surface;

rotary cutter means mounted upon said apparatus so as to be disposed at a predetermined position above the roadway surface in order to enable said rotary cutter means to engage pavement markers fixedly mounted upon the roadway surface and sever the pavement markers from the roadway surface; and means mounted upon said apparatus for removing severed pavement marker debris severed by said rotary cutter means.

18. The apparatus as set forth in claim 17, wherein:

said means for removing said severed pavement marker debris comprises suction exhaust means.

19. The apparatus as set forth in claim 18, wherein:

said rotary cutter means comprises three cutter implements; and motor drive means, mounted upon said apparatus and operatively connected to said three cutter implements, comprises a motor drive shaft upon which a first one of said three cutter implements is rotatably mounted, a drive pulley fixedly mounted upon said motor drive shaft, a pair of driven pulleys mounted upon driven shafts upon which second and third ones of said three cutter implements are mounted, and a drive belt operatively interconnecting said drive pulley to said pair of driven pulleys.

20. The apparatus as set forth in claim 18, further comprising:

brush means dependently supported from said apparatus in a peripheral array around said apparatus for engaging the roadway surface so as to effectively form a sealed region beneath said apparatus whereby as said apparatus is moved along the roadway surface along with the automotive roadwork vehicle, severed pavement marker debris is effectively contained within said sealed region so as to facilitate the exhaust of said severed pavement marker debris by said suction exhaust means.

21. In combination, apparatus, attachable to an automotive roadwork vehicle so as to be movable along with the automotive roadwork vehicle as the automotive roadwork vehicle moves over a roadway surface, for automatically removing pavement markers from a roadway surface, comprising:

an automotive roadwork vehicle;

at least one wheel assembly rotatably mounted upon said apparatus for rollably supporting said apparatus upon the roadway surface upon which the plurality of pavement markers, to be removed, are disposed;

means for attaching said apparatus to said automotive roadwork vehicle so as to be movable along with said automotive roadwork vehicle as said automotive roadwork vehicle moves over the roadway surface;

rotary cutter means disposed upon said apparatus so as to be disposed at a predetermined position above the roadway surface in order to enable said rotary cutter means to engage pavement markers fixedly mounted upon the roadway surface and sever the pavement markers from the roadway surface; and means mounted upon said apparatus for removing severed pavement marker debris severed by said rotary cutter means.

22. The combination as set forth in claim 21, wherein:

said means for removing said severed pavement marker debris comprises suction exhaust means.

23. The combination as set forth in claim 21, wherein:

said rotary cutter means comprises three cutter implements; and motor drive means, mounted upon said apparatus and operatively connected to said three cutter implements, comprises a motor drive shaft upon which a first one of said three cutter implements is rotatably mounted, a drive pulley fixedly mounted upon said motor drive shaft, a pair of driven pulleys mounted upon driven shafts upon which second and third ones of said three cutter implements are mounted, and a drive belt operatively interconnecting said drive pulley to said pair of driven pulleys.

24. The combination as set forth in claim 21, further comprising:

brush means dependently supported from said apparatus in a peripheral array around said apparatus for engaging the roadway surface so as to effectively form a sealed region beneath said apparatus whereby as said apparatus is moved along the roadway surface along with said automotive roadwork vehicle, severed pavement marker debris is effectively contained within said sealed region so as to facilitate the exhaust of said severed pavement marker debris by said suction exhaust means.

* * * * *